United States Patent [19]

Best et al.

[11] Patent Number: 4,498,707

[45] Date of Patent: Feb. 12, 1985

[54] CUTTING ROLLER

[75] Inventors: Gerd Best, Sprockhövel; Norbert B. Weikert, Dortmund, both of Fed. Rep. of Germany

[73] Assignee: Krampe & Co. Fertigung in Bergbaubedarf GmbH Zweigniederlassung, Pelkum, Fed. Rep. of Germany

[21] Appl. No.: 526,164

[22] Filed: Aug. 24, 1983

[30] Foreign Application Priority Data

Jan. 22, 1983 [DE] Fed. Rep. of Germany ..... 3302103

[51] Int. Cl.[3] ..... E21C 7/08

[52] U.S. Cl. ..... 299/81; 299/12

[58] Field of Search ..... 299/87, 81, 12; 137/68 R, 71

[56] References Cited

U.S. PATENT DOCUMENTS

| | | | |
|---|---|---|---|
| 733,372 | 7/1903 | Colwell | 137/71 |
| 1,348,708 | 8/1920 | Garland | 137/68 R |
| 4,219,239 | 8/1980 | Weikert et al. | 299/90 X |

FOREIGN PATENT DOCUMENTS

| | | | |
|---|---|---|---|
| 1126766 | 6/1982 | Canada | 299/81 |
| 0621873 | 8/1978 | U.S.S.R. | 299/81 |
| 0717326 | 2/1980 | U.S.S.R. | 299/81 |

*Primary Examiner*—Stephen J. Novosad
*Assistant Examiner*—Michael Starinsky
*Attorney, Agent, or Firm*—Michael J. Striker

[57] ABSTRACT

In a cutting roller, preferably for a winning machine and provided with a plurality of picks on its blade and with a number of fluid-spraying nozzles for cooling the picks, each nozzle is screwed into a nozzle-receiving member into which a shutoff valve is inserted which opens the bore in the nozzle-receiving member for connecting the passage for supplying fluid with the nozzle when the latter is inserted into that bore or automatically blocks that bore when the nozzle is removed from that bore.

5 Claims, 3 Drawing Figures

CUTTING ROLLER

BACKGROUND OF THE INVENTION

The present invention relates to a cutting roller for winning machines.

More particularly the invention relates to the cutting roller equipped with a so-called individual fluid-spraying system.

Cutting rollers for mining machines are normally provided with a plurality of picks arranged on the helical blade of the roller and wherein spraying nozzles are provided for individual picks in the vicinity thereof to cool the latter. The hydraulic fluid sprayed out from the nozzles not only cools the cutting picks but also produces an intensive spray mist which surrounds the rotating cutting roller and suppresses coal or mineral dust generated during the mining operation and thus prevents contamination of the environment.

Spraying nozzles utilized in such cutting rollers are often rubbed off or brake particularly due to various malfunctions in operating in mountains. This results in that the hydraulic fluid, e.g. water, which is used for spraying onto the picks seeks for easier ways to flow and can flow into unblocked passages, which unfavorably effects the normal operation. Furthermore, due to the necessity to save water and because the defective spraying nozzles contribute to the waste of water they should be replaced by new spraying nozzles. Although the amount of fluid utilized for cooling the picks and damping the dust always involves loss of water the defective spraying nozzles make this loss considerably worse.

SUMMARY OF THE INVENTION

It is an object of the present invention to provide a cutting roller for a winning machine with an improved spray-nozzle system.

It is another object of the invention to provide a spraying nozzle system which would ensure that even in the event that the spraying nozzle is completely broken or worn out, no fluid losses will occur in the region of the nozzle.

These and other objects of the invention are attained by a cutting roller comprising at least one blade with a peripheral surface; a plurality of cutting tools arranged on said peripheral surface; a plurality of spraying nozzles each arranged near the respective cutting tool and assigned thereto to spray a hydraulic fluid thereonto; a plurality of nozzle-receiving members mounted in said blade and each formed with a bore to receive the respective nozzle therein, said blade being formed with a plurality of connection passages arranged in communication with a source of hydraulic fluid and each connected to the respective bore of the nozzle-receiving member to supply fluid to the respective nozzle; and a plurality of locking valves each mounted in the respective bore of the nozzle-receiving member, said locking valves each being operative to open said bore so as to allow the fluid to flow from the respective connection passage into the respective spraying nozzle and then towards the respective cutting tool when the nozzle is inserted into said bore or to automatically sealingly block said bore to prevent the fluid from flowing from the respective connection passage towards the respective cutting tool when the nozzle is removed or partially displaced from said bore.

According to the invention each nozzle is provided with an automatically operated locking or shutoff valve which ensures that if the spraying nozzle is crushed or worn out the fluid can not flow from the connection passage into an opening from which the spray is directed towards the respective cutting pick. Thus this automatically operative locking valve is constantly at the stand-by condition and works instantly as soon the spraying nozzle assigned therewith is broken or inadvertently displaced from the bore in the nozzle-receiving member. The locking valve in this case blocks the passage to fluid from the fluid supplying channel to the respective spraying nozzle so that it is warranted that the fluid can not leave the fluid-supplying passage or channel when it is not necessary.

The nozzle structure according to the invention is very simple and inexpensive in manufacturing as compared to those currently used in practice.

According to a further feature of the invention each spraying nozzle has a hollow cylindrical portion, each nozzle-receiving member having a supporting ring connected thereto, each locking valve having a body and a compression spring, said compression spring being supported in said bore between said body and said supporting ring, said cylindrical portion having a face which presses against said valve body against a restoring force of said compression spring when the nozzle is fully inserted into said bore to push the valve into an opening position in which said bore is open.

Furthermore, each nozzle-receiving member may be cylindrical and formed with an outer thread to be screwed into the blade, said nozzle-receiving member together with the respective spraying nozzle and the respective locking valve forming an interchangeable armature-like unit.

Since the nozzle-receiving member is not welded to the blade but instead is screwed into the body of the blade a quick replacement of that unit is ensured. Furthermore, thermal loads on the components of the nozzle structure are prevented.

The nozzle structure of the cutting roller of the present invention is reliable in operation and is particularly suitable for underground coal mining.

The armature-like unit including the nozzle, nozzle-receiving member and the valve is very compact and is very easy to handle. These units which have an outer thread can be screwed into respective openings provided in the helical blade and the locking ring of the cutting roller. The nozzle is screwed into the nozzle-receiving member whereas the body of the locking valve inserted in the cartridge-like nozzle-receiving member is supported against the back face of the nozzle.

The above-mentioned supporting ring can be formed as a Seeger ring which supports the spring so that the body of the valve is spring-loaded.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
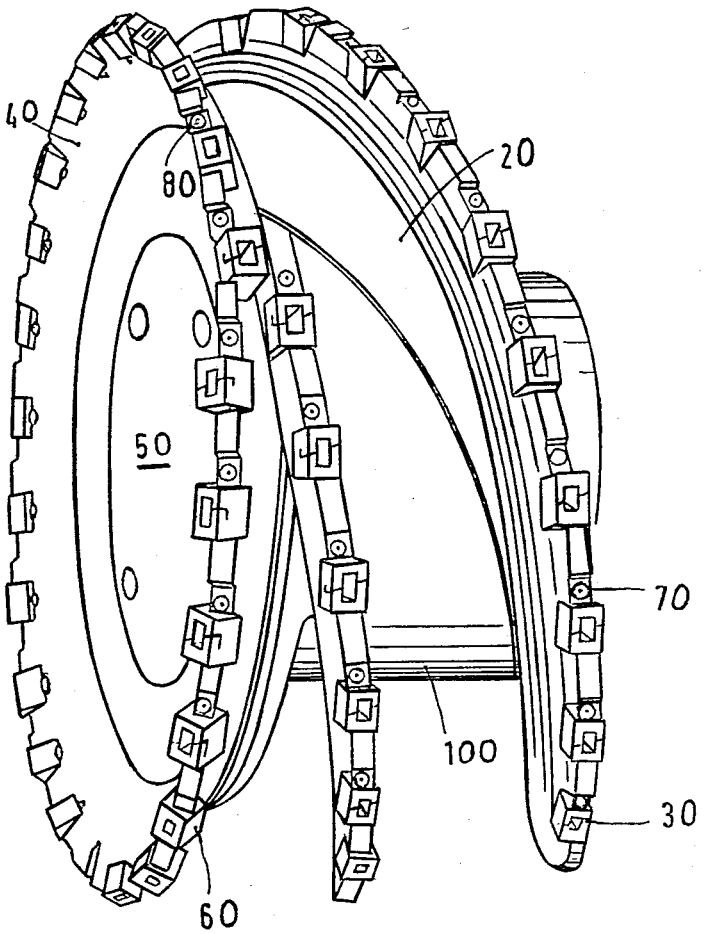
FIG. 1 is a perspective view of a cutting roller provided with spraying nozzles according to the invention.

FIG. 1 illustrates a cutting drum or roller for a winning machine. It should be noted that the invention is particularly advantageous when applied to the cutting roller utilized for underground mining. The cutting roller is known per se and includes a tubular support element 100 and at least one helical blade 20. A locking ring 40 is connected to the support element 100 at the front end thereof. Locking ring 40 is closed with a cover 50. The blade as well as the locking ring are provided with a plurality of pick holders 30, 60 circumferentially spaced from each other and holding cutting picks (not shown) in the conventional manner. A plurality of spraying nozzles 70 are arranged on the periphery of the blade and the locking ring, each of which corresponds to the assigned individual pick to spray a hydraulic fluid, e.g. water, onto the pick during the mining in order to cool the pick and to suppress coal dust surrounding the pick. A water-conducting system which supplies water to the individual nozzles 70 is provided in the conventional fashion in the cutting roller.

Figure 2:
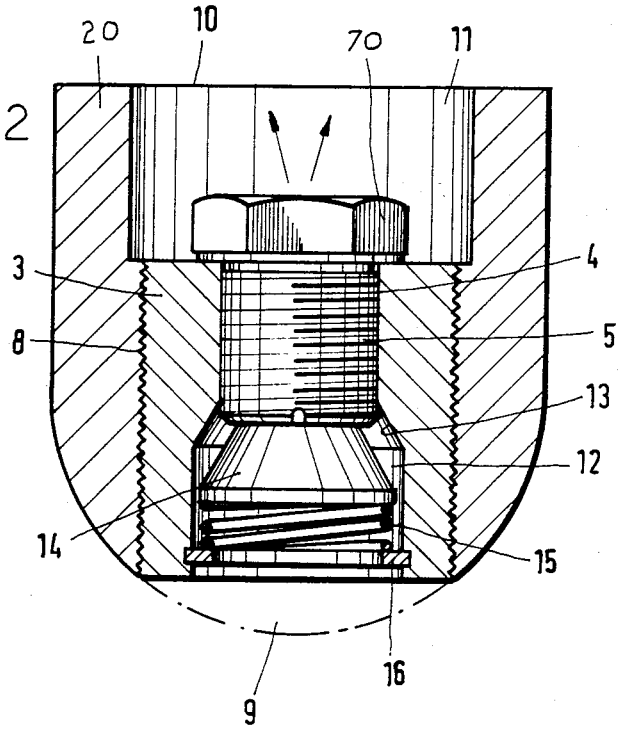
FIG. 2 is a sectional view of the spraying nozzle with a shutoff valve in the open position.
Figure 3:
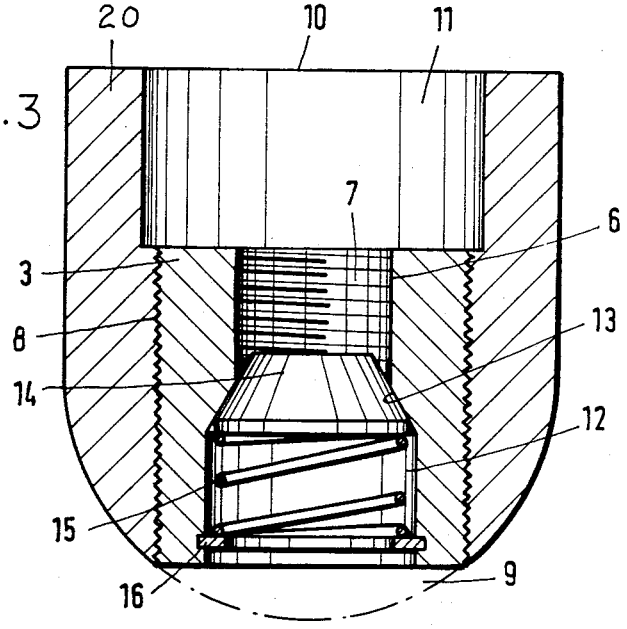
FIG. 3 is a sectional view of the nozzle-receiving member with the shutoff valve in the closed position and with the spraying nozzle removed.

Referring to FIGS. 2 and 3 illustrating the spraying nozzle in detail, reference character 20 denotes the part of the blade in which the spraying nozzle is located. Only one nozzle is shown in FIGS. 3 and 4 for the sake of simplicity. A number of spraying nozzles 70 as shown in FIG. 1 are arranged on the blade 20, the spraying nozzles being spaced from each other in the circumferential direction. Each spraying nozzle has a cylindrical portion 5 which is screwed into a cartridge-like nozzle-receiving member 3 by means of outer thread 4 on the nozzle 70 and the inner thread 6 formed in the cylindrical portion 5 of the central opening 7 formed in the nozzle-receiving member 3.

The cartridge-like nozzle-receiving member 3 is of cylindrical shape and provided with the outer thread 8 by means of which member 3 is screwed into a respective bore formed in the blade and constituting a connection passage 9 which, in turn, is connected to a spraying water supply conduit (not shown) in the known per se manner. The connection passage 9, on the other hand, opens, at the distance from the edge 10 of blade 20, into a passage portion 11 which is of the diameter larger than that of the bore forming the connection passage 9.

Bore 7 has a second cylindrical portion of an enlarged diameter, which portion forms a valve chamber 12. The upper portion of bore 7 (in the plane of the drawings) and the lower portion thereof which forms valve chamber 12 are connected to each other by a conical intermediate portion which forms a valve seat 13. A shutoff or locking valve 14 the shape of which corresponds to the shape of the intermediate portion of bore 7 is adapted to fluid-tightly thrust against the valve seat 13 as shown in FIG. 3. The locking valve 14 is loaded at the back side thereof with a compression spring 15 which is supported against a Seeger ring 16 which is inserted into the nozzle-receiving member 3. Seeger ring 16 can be detached from member 3.

The fluid-spraying nozzle 70, its cylindrical portion, the bore forming the connection passage 9, the valve chamber 12, the locking valve 14, the nozzle-receiving member 3 and the compression spring 15 are all coaxially aligned with each other.

It is to be understood that the nozzle-receiving member 3 and the spraying nozzle 70 support the shutoff valve which is formed by the valve body 14, compression spring 15 and Seeger ring 16. Consequently, spraying nozzle 70, valve 14 compression spring 15 and Seeger ring 16 form an armature portion as a whole integral hand-manipulated (movable) unit which is very compact because all the parts of that unit are arranged in a relatively narrow space in the cartridge-like fashion.

The usual operative position is shown in FIG. 2. The cylindrical portion 5 of nozzle 70 presses against the restoring force of the compression spring 15 to push the shutoff valve 14 into the opening position so that the hydraulic fluid flowing through the connection passage 9 is able to enter the interior of the cylindrical portion 5 of the nozzle 70 and flow outwards of the nozzle. In the event that the spraying nozzle 70 is dismounted, or clogged, or somehow worn out, or broken or somehow removed from the position shown in FIG. 1, the compression spring 15 then presses the body of the valve 14 against the valve seat 13 into the closed position in which bore 7 will be sealingly blocked from connection passage 9. As shown in FIG. 2 in this closed position fluid can not flow outside of the connection passage.

The nozzle-receiving member 3 with the Seeger ring 16 connected thereto by any known means and together with the nozzle 70, valve body 14, and spring 15 inserted thereinto forms an interchangeable armature-like unit which can be replaced if and when desired.

It is to be understood that similar interchangeable armature-like nozzle structures can be inserted near the cutting picks of the locking ring of the cutting roller.

It will be understood that each of the elements described above, or two or more together, may also find a useful application in other types of cutting rollers differing from the types described above.

While the invention has been illustrated and described as embodied in a cutting drum, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cutting roller, comprising at least one blade with a peripheral surface; a plurality of cutting tools arranged on said peripheral surface; a plurality of interchangeable spraying nozzle units inserted in said blade and each being arranged near the respective cutting tool and assigned thereto to spray a hydraulic fluid thereonto; each nozzle unit including a spraying nozzle, a nozzle-receiving member formed with a bore to receive said spraying nozzle therein, and locking valve also mounted in said bore immediately against said spraying nozzle to abut the latter when the nozzle is fully inserted into said bore; said nozzle receiving member, said spraying nozzle and said locking valve being arranged in each unit coaxially to each other in a cartridge-like manner, said blade being formed with a plurality of connection passages arranged in communication with a source of hydraulic fluid and each connected to the respective bore of the nozzle-receiving member to supply fluid to the respective nozzle; said locking valve continually opening said bore so as to allow the fluid to flow from the respective connection passage into the spraying nozzle of the respective unit and then towards the respective cutting tool when the spraying nozzle is fully inserted into said bore and automatically sealingly blocking said bore to prevent the fluid from flowing from the respective connection passage towards the respective cutting tool when the nozzle is completely removed from said bore.

2. The cutting roller as defined in claim 1, wherein said spraying nozzle has a hollow cylindrical portion, said nozzle-receiving member having a supporting ring connected thereto, said locking valve having a body and a compression spring, said compression spring being supported in said bore between said body and said supporting ring, said cylindrical portion having a face which presses against said valve body against a restoring force of said compression spring when the nozzle is fully inserted into said bore to push the valve into an opening position in which said bore is open.

3. The cutting roller is defined in claim 2, wherein said nozzle-receiving member is cylindrical and formed with an outer thread to be screwed into the blade.

4. The cutting roller as defined in claim 3, wherein said bore includes a cylindrical portion for receiving the cylindrical portion of the nozzle, a conical portion which forms a valve seat for said valve body and another cylindrical portion which receives said compression spring.

5. The cutting roller as defined in claim 4, wherein said valve body is of conical configuration which matches to the configuration of said conical portion of the bore.

* * * * *